US012753460B2

(12) United States Patent
Hironaka et al.

(10) Patent No.: US 12,753,460 B2
(45) Date of Patent: Oct. 6, 2026

(54) STEEL SHEET

(71) Applicant: NIPPON STEEL CORPORATION, Tokyo (JP)

(72) Inventors: Satoshi Hironaka, Tokyo (JP); Yasuhiro Ito, Tokyo (JP); Mai Nagano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 365 days.

(21) Appl. No.: 18/693,812

(22) PCT Filed: Aug. 23, 2022

(86) PCT No.: PCT/JP2022/031750
§ 371 (c)(1),
(2) Date: Mar. 20, 2024

(87) PCT Pub. No.: WO2023/100424
PCT Pub. Date: Jun. 8, 2023

(65) Prior Publication Data

US 2024/0392406 A1 Nov. 28, 2024

(30) Foreign Application Priority Data

Dec. 3, 2021 (JP) ..... 2021-197308

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/005* (2013.01)

(58) Field of Classification Search
CPC ..... C21D 9/46; C21D 2211/005; C21D 2211/001; C21D 2211/009; C21D 6/005; C21D 8/02; C21D 8/0226; C21D 8/0236; C21D 8/0263; C21D 2201/05; C21D 2211/002; C21D 2211/008; C22C 38/001; C22C 38/002; C22C 38/02; C22C 38/04; C22C 38/06; C22C 38/005; C22C 38/008; C22C 38/12; C22C 38/20; C22C 38/22; C22C 38/26; C22C 38/28; C22C 38/32; C22C 38/38; C22C 38/44; C22C 38/58; C22C 38/60; C22C 38/42; C22C 38/46; C22C 38/50; C22C 38/54
See application file for complete search history.

(56) References Cited

U.S. PATENT DOCUMENTS

2019/0085427 A1* 3/2019 Takashima ..... C21D 9/46
2022/0316020 A1 10/2022 Kubo et al.

FOREIGN PATENT DOCUMENTS

JP 2005-220430 A 8/2005
WO WO 2020/145256 A1 7/2020

* cited by examiner

*Primary Examiner* — Ricardo D Morales
(74) *Attorney, Agent, or Firm* — Birch, Stewart, Kolasch & Birch, LLP

(57) ABSTRACT

Provided is a steel sheet having a predetermined chemical composition, wherein an index A represented by 10[C]+0.3[Mn]−0.2[Si]−0.6[Al]−0.05[Cr]−0.2[Mo] is 1.10% or less, and a microstructure comprising, by area %, ferrite: 70 to 95%, and a hard phase: 5 to 30%, wherein a maximum connected length of the hard phase in a rolling direction at a sheet thickness ½ position is 80 μm or less, and a maximum connected length of the hard phase in a rolling direction at a sheet thickness ¼ position is 40 μm or less.

4 Claims, No Drawings

STEEL SHEET

FIELD

The present invention relates to a steel sheet.

BACKGROUND

In the auto industry, lighter weight of vehicle bodies is being sought from the viewpoint of improvement of fuel economy. To achieve both lighter weight of vehicle bodies and collision safety, increasing the strength of the steel sheet used would be one effective method. Development of high strength steel sheet is underway from such a background.

In relation to this, PTL 1 describes a high strength hot dip galvanized steel sheet comprised of a base sheet of steel sheet having a hot dip galvanized plating layer on its surface, wherein the base sheet contains, by mass %, C: 0.02 to 0.20%, Si: 0.7% or less, Mn: 1.5 to 3.5%, P: 0.10% or less, S: 0.01% or less, Al: 0.1 to 1.0%, N: 0.010% or less, and Cr: 0.03 to 0.5%, wherein an annealing surface oxidation index A, defined by the numerical formula: A=400Al/(4Cr+3Si+6Mn) having the contents of Al, Cr, Si, and Mn as terms, is 2.3 or more, and a balance of Fe and unavoidable impurities, and, further, a microstructure of the base sheet comprised of ferrite and a second phase, wherein the second phase is mainly comprised of martensite. Further, PTL 1 describes that the high strength hot dip galvanized steel sheet has an excellent surface quality and a tensile strength of 590 MPa or more suitable for application as mainly structural members, rocker panels, and other structural parts of automobiles.

PTL 2 describes a steel sheet comprising, as a chemical composition, by mass %, C: 0.020% to 0.090%, Si: 0.200% or less, Mn: 0.45% to 2.10%, P: 0.030% or less, S: 0.020% or less, sol. Al: 0.50% or less, N: 0.0100% or less, B: 0% to 0.0050%, Mo: 0% to 0.40%, Ti: 0% to 0.10%, Nb: 0% to 0.10%, Cr: 0% to 0.55%, Ni: 0% to 0.25%, and a remainder of Fe and impurities, wherein a metallographic structure in a surface layer region ranging from a surface to a position of 20 μm from the surface in a sheet thickness direction consists of ferrite and a secondary phase having a volume fraction of 0.010% to 5.0%, a metallographic structure in an internal region ranging from a position of more than 20 μm from the surface in the sheet thickness direction to a ¼ thickness position from the surface in the sheet thickness direction consists of ferrite and a secondary phase having a volume fraction of 2.0% to 10.0%, the volume fraction of the secondary phase in the surface layer region is less than the volume fraction of the secondary phase in the internal region, and in the surface layer region, an average grain size of the secondary phase is 0.01 μm to 4.0 μm, and a texture in which an $X_{ODF\{001\}/\{111\}}$ as a ratio of an intensity of {001} orientation to an intensity of {111} orientation in the ferrite is 0.60 or more and less than 2.00 is included. Further, PTL 2 describes that the occurrence of surface unevenness is suppressed even after various deformation during press forming as compared to a material in the related art, and therefore the steel sheet has excellent appearance quality of the surface and can contribute to improvement of the vividness and design of coating.

CITATIONS LIST

Patent Literature

[PTL 1] Japanese Unexamined Patent Publication No. 2005-220430

[PTL 2] WO 2020/145256

SUMMARY

Technical Problem

In recent years, in response to demands for further improvement of fuel economy, the need for lighter weight has been rising not only in the structural members and other structural parts described in PTL 1, but also roofs, hoods, fenders, doors, and other outer panels. These outer panels differ from such structural parts. They are visible to the human eye, therefore not only strength and other properties, but also design freedom and surface quality are important. Therefore, excellent appearance after forming is sought. On the other hand, in response to such demands for lighter weight, even further higher strength and thinness are being sought in steel sheet used for such outer panels. In addition, along with the increasing complexity of shapes in these outer panels, irregularities tend to easily form on the surface of the steel sheet after forming. If such irregularities form, there is the problem that the appearance deteriorates.

More specifically, for example, in the case of DP steel (dual phase steel) comprised of soft ferrite and a hard second phase mainly comprised of martensite such as described in PTL 1, at the time of press-forming and other working, uneven shaping where the soft phase comprised of ferrite and its surroundings are preferentially changed in shape easily occurs. For this reason, if utilizing such dual phase steel comprised of a soft phase and hard phase, fine irregularities form on the surface of the steel sheet after forming, whereby defects in appearance called "ghost lines" sometimes appear. In relation to this, PTL 2 describes that by forming the metallographic structure of the surface layer region by ferrite and a secondary phase having a volume fraction of 0.010% to 5.0%, making the volume fraction of the secondary phase of the surface layer region less than the volume fraction of the secondary phase in the internal region, and further increasing the volume fraction of the secondary phase in the internal region, the suppression of the occurrence of the surface unevenness during forming and the material strength of a tensile strength of 400 MPa or more can be achieved simultaneously. On the other hand, in the automobile industry, etc., further lighter weight of the steel sheet is also being sought. To achieve such lighter weight, a need arises to make the steel sheet higher in strength than before. Therefore, a high need remains for steel sheet able to solve the problem of fine irregularities able to be formed on the surface of steel sheet after forming even in the case of increasing the strength to equal to or greater than the past.

Therefore, the present invention has as its object the provision of a high strength steel sheet having an improved appearance after forming by a novel constitution.

Solution to Problem

The inventors engaged in studies focusing on the morphology of the hard phase in the microstructure so as to achieve the above object. As a result, the inventors discovered that by decreasing the formation of a banded hard phase and making the hard phase disperse more evenly in the microstructure, the high strength due to such a hard phase is maintained while formation of fine irregularities at the surface of the steel sheet is remarkably suppressed even when strain is imparted due to forming, etc., and thereby completed the present invention.

The present invention able to achieve the above object is as follows:

(1) A steel sheet having a chemical composition comprising, by mass %,
C: 0.040 to 0.100%,
Mn: 1.00 to 2.50%,
Si: 0.005 to 1.500%,
P: 0.100% or less,
S: 0.0200% or less,
Al: 0.005 to 0.700%,
N: 0.0150% or less,
O: 0.0100% or less,
Cr: 0 to 0.80%,
Mo: 0 to 0.50%,
B: 0 to 0.0100%,
Ti: 0 to 0.100%,
Nb: 0 to 0.060%,
V: 0 to 0.50%,
Ni: 0 to 1.00%,
Cu: 0 to 1.00%,
W: 0 to 1.00%,
Sn: 0 to 1.00%,
Sb: 0 to 0.200%,
Ca: 0 to 0.0100%,
Mg: 0 to 0.0100%,
Zr: 0 to 0.0100%,
REM: 0 to 0.0100%, and
balance: Fe and impurities, wherein
an index A represented by following formula 1 is 1.10% or less, and
a microstructure comprising, by area %,
ferrite: 70 to 95%, and
a hard phase: 5 to 30%, wherein
a maximum connected length of the hard phase in a rolling direction at a sheet thickness ½ position is 80 μm or less, and
a maximum connected length of the hard phase in a rolling direction at a sheet thickness ¼ position is 40 μm or less:

$$A=10[C]+0.3[Mn]-0.2[Si]-0.6[Al]-0.05[Cr]-0.2[Mo] \quad \text{formula 1}$$

where [C], [Mn], [Si], [Al], [Cr], and [Mo] are the contents of the elements [mass %], and when the elements are not contained, the contents are 0%.

(2) The steel sheet according to (1), wherein the chemical composition contains, by mass %, one or more selected from the group consisting of
Cr: 0.001 to 0.80%,
Mo: 0.001 to 0.50%,
B: 0.0001 to 0.0100%,
Ti: 0.001 to 0.100%,
Nb: 0.001 to 0.060%,
V: 0.001 to 0.50%,
Ni: 0.001 to 1.00%,
Cu: 0.001 to 1.00%,
W: 0.001 to 1.00%,
Sn: 0.001 to 1.00%,
Sb: 0.001 to 0.200%,
Ca: 0.0001 to 0.0100%,
Mg: 0.0001 to 0.0100%,
Zr: 0.0001 to 0.0100%, and
REM: 0.0001 to 0.0100%.

(3) The steel sheet according to (1) or (2), wherein an average crystal grain size of the ferrite is 5.0 to 30.0 μm and an average crystal grain size of the hard phase is 1.0 to 5.0 μm.

(4) The steel sheet according to any one of (1) to (3), wherein the hard phase is comprised of at least one structure of martensite, bainite, tempered martensite, and pearlite.

Advantageous Effects of Invention

According to the present invention, it is possible to provide a high strength steel sheet having an improved appearance after forming.

EMBODIMENTS OF INVENTION

<Steel Sheet>

The steel sheet according to an embodiment of the present invention has a chemical composition comprising, by mass %,
C: 0.040 to 0.100%,
Mn: 1.00 to 2.50%,
Si: 0.005 to 1.500%,
P: 0.100% or less,
S: 0.0200% or less,
Al: 0.005 to 0.700%,
N: 0.0150% or less,
O: 0.0100% or less,
Cr: 0 to 0.80%,
Mo: 0 to 0.50%,
B: 0 to 0.0100%,
Ti: 0 to 0.100%,
Nb: 0 to 0.060%,
V: 0 to 0.50%,
Ni: 0 to 1.00%,
Cu: 0 to 1.00%,
W: 0 to 1.00%,
Sn: 0 to 1.00%,
Sb: 0 to 0.200%,
Ca: 0 to 0.0100%,
Mg: 0 to 0.0100%,
Zr: 0 to 0.0100%,
REM: 0 to 0.0100%, and
balance: Fe and impurities, wherein
an index A represented by following formula 1 is 1.10% or less, and
a microstructure comprising, by area %,
ferrite: 70 to 95%, and
a hard phase: 5 to 30%, wherein
a maximum connected length of the hard phase in a rolling direction at a sheet thickness ½ position is 80 μm or less, and
a maximum connected length of the hard phase in a rolling direction at a sheet thickness ¼ position is 40 μm or less:

$$A=10[C]+0.3[Mn]-0.2[Si]-0.6[Al]-0.05[Cr]-0.2[Mo] \quad \text{formula 1}$$

where [C], [Mn], [Si], [Al], [Cr], and [Mo] are the contents of the elements [mass %], and when the elements are not contained, the contents are 0%.

In a roof or door or other outer panel, from the viewpoint of avoiding surface defects called "surface strain" occurring at the time of press-forming, etc., in many cases use is made of DP steel which has a relatively low yield strength. However, as explained previously, in the case of DP steel, which is made of a mixture of a soft phase comprised of ferrite and a hard phase mainly comprised of martensite, etc., uneven changes in shape where the soft phase and its surroundings change in shape preferentially easily occur at the time of press-forming or other working and fine irregularities are formed at the surface of the steel sheet after forming, whereby sometimes defects in appearance called "ghost lines" are formed. Explained in more detail, at the time of press-forming and other working, the shape is changed so that the soft phase comprised of ferrite becomes pushed down, while the hard phase mainly comprised of martensite, etc., does not become pushed down or rather is built up so as to project out, whereby ghost lines are formed in a band shapes (streaks). Therefore, the inventors engaged in studies to reduce such defects in appearance after forming by focusing on the morphology of the hard phase in the microstructure. As a result, the inventors discovered that in steel sheet made of a mixture of a soft phase and a hard phase like DP steel, the presence of grains of the hard phase connected in streaks in the microstructure causes ghost lines to become conspicuous in extent. Furthermore, the inventors discovered that by reducing the formation of such a banded hard phase to make the hard phase be dispersed more uniformly in the microstructure, it is possible to maintain the high strength due to such a hard phase while remarkably suppressing formation of fine irregularities at the surface of the steel sheet even when strain is imparted due to forming, etc., and thereby remarkably suppressed the formation of ghost lines.

More specifically, the inventors discovered that to suppress the formation of banded structures related to the hard phase, it is effective to reduce Mn segregation at the time of solidification at the slab casting step of solidifying molten steel to cast a slab and engaged in detailed studies on techniques for reducing Mn segregation from the two viewpoints of center segregation and microsegregation relating to this.

First, the inventors engaged in various studies to reduce center segregation with the idea that inhibiting the flow of the molten steel at the time of slab casting would be effective. Explained this in more detail, at the time of solidification, molten steel only naturally solidifies from the surface. The center part solidifies last. If molten steel solidifies, the solid phase is discharged from the liquid phase, therefore at that stage, Mn concentrates in the liquid phase. Therefore, if molten steel flows at the time of solidification, such concentrated parts of Mn easily gather at the center part which solidifies last. As a result, the center segregation of Mn becomes remarkable. Therefore, the inventors discovered that, as explained in detail later in relation to the method of production of steel sheet, it is possible to suitably control the conditions at the time of solidification to suppress such flow of molten steel to thereby remarkably suppress center segregation of Mn and it is possible to control a maximum connected length of the hard phase in a rolling direction at a sheet thickness ½ position of the finally obtained steel sheet in relation to this to 80 μm or less.

On the other hand, the inventors engaged in various studies to reduce microsegregation with the idea that promoting the diffusion of Mn at the time of solidification would be effective. To promote the diffusion of Mn, creating a microstructure in which Mn can easily diffuse would be effective. Therefore, the inventors took note of the 6 phase with the fast speed of diffusion of Mn and investigated by experiments the degree of effect on the microsegregation of Mn at the elements in steel for making the solidification mode the 6 solidification. As a result, the inventors discovered that if the C and Mn contents become higher, the mode of solidification does not become 6 solidification, the speed of diffusion of Mn falls, and microsegregation visibly tends to increase, but for Si, Al, Cr, and Mo, if the contents of this become higher, diffusion of Mn at the time of solidification is promoted and microsegregation can be reduced. More specifically, the inventors discovered that by controlling an index A prescribed by a coefficient considering the degree of effect relating to microsegregation and the contents of these elements, i.e., the index A represented by following formula 1, to 1.10% or less, it is possible to remarkably suppress the microsegregation of Mn and, in relation to this, possible to control the maximum connected length of the hard phase in a rolling direction at the sheet thickness ¼ position of the finally obtained steel sheet to 40 μm or less:

$$A=10[C]+0.3[Mn]-0.2[Si]-0.6[Al]-0.05[Cr]-0.2[Mo] \quad \text{formula 1}$$

where [C], [Mn], [Si], [Al], [Cr], and [Mo] are the contents of the elements [mass %], and when the elements are not contained, the contents are 0%.

According to the steel sheet according to an embodiment of the present invention, as explained above, by remarkably reducing both the center segregation and microsegregation of Mn, it is possible to control the maximum connected lengths of the hard phase in a rolling direction at the sheet thickness ½ position and ¼ position of the steel sheet to within predetermined ranges, i.e., possible to remarkably suppress the formation of a banded hard phase in the microstructure of the finally obtained steel sheet to make the hard phase disperse more uniformly in the microstructure as a whole. Therefore, according to the steel sheet according to an embodiment of the present invention, it is possible to sufficiently maintain the high strength based on the hard phase while remarkably suppressing the formation of fine irregularities at the surface of the steel sheet even when strain has been imparted due to press-forming and other forming and thereby possible to remarkably suppress the occurrence of ghost lines and other defects in appearance. For this reason, according to an embodiment of the present invention, it is possible to provide a high strength steel sheet having an improved appearance after forming.

Below, the steel sheet according to an embodiment of the present invention will be explained in more detail. In the following explanation, the units "%" of contents of the elements mean "mass %" unless otherwise indicated. Further, in this Description, the "to" showing a numerical range, unless otherwise indicated, is used in the sense including the numerical values before and after it as the lower limit value and upper limit value.

[C: 0.040 to 0.100%]

C is an element increasing the strength of a steel sheet. To sufficiently obtain such an effect, the C content is 0.040% or more. The C content may also be 0.045% or more, 0.050% or more, 0.055% or more, or 0.060% or more. On the other hand, if excessively including C, the diffusion of Mn at the time of solidification is inhibited and sometimes the microsegregation of Mn cannot be sufficiently suppressed. Therefore, the C content is 0.100% or less. The C content may also be 0.095% or less, 0.090% or less, 0.080% or less, or 0.070% or less.

[Mn: 1.00 to 2.50%]

Mn is an element raising the hardenability of steel to contribute to improvement of the strength. To sufficiently obtain such an effect, the Mn content is 1.00% or more. The Mn content may also be 1.20% or more, 1.30% or more, 1.40% or more, or 1.50% or more. On the other hand, if excessively including Mn, the diffusion of Mn at the time of solidification is inhibited. The microsegregation of Mn sometimes cannot be sufficiently suppressed. Therefore, the Mn content is 2.50% or less. The Mn content may also be 2.25% or less, 2.10% or less, 2.00% or less, 1.85% or less, or 1.75% or less.

[Si: 0.005 to 1.500%]

Si is a deoxidizing element of steel and an element effective for raising the strength without detracting from the ductility of the steel sheet. Further, Si is an element effective for promoting the diffusion of Mn at the time of solidification to reduce the microsegregation of Mn. To sufficiently obtain these effects, the Si content is 0.005% or more. The Si content may also be 0.010% or more, 0.050% or more, 0.100% or more, or 0.150% or more. On the other hand, if excessively including Si, the peelability of the scale falls and sometimes surface defects are formed. Therefore, the Si content is 1.500% or less. The Si content may also be 1.400% or less, 1.200% or less, 1.000% or less, 0.850% or less, less than 0.600%, 0.550% or less, 0.500% or less, or 0.300% or less.

[P: 0.100% or Less]

P is an element entering in the production process. The P content may also be 0%. However, reduction of the P content to less than 0.0001% requires time for refining and a drop in productivity is invited. Therefore, the P content may also be 0.0001% or more, 0.0005% or more, 0.001% or more, or 0.005% or more. On the other hand, if excessively including P, sometimes the toughness of the steel sheet falls. Therefore, the P content is 0.100% or less. The P content may also be 0.070% or less, 0.060% or less, 0.040% or less, or 0.020% or less.

[S: 0.0200% or Less]

S is an element entering in the production process. The S content may also be 0%. However, reduction of the S content to less than 0.0001% requires time for refining and a drop in productivity is invited. Therefore, the S content may also be 0.0001% or more, 0.0005% or more, or 0.0010% or more. On the other hand, if excessively including S, Mn sulfides are formed and the steel sheet is sometimes made to decline in ductility, hole expandability, stretch flangeability, and/or bendability or other formability. Therefore, the S content is 0.0200% or less. The S content may also be 0.0100% or less, 0.0060% or less, or 0.0040% or less.

[Al: 0.005 to 0.700%]

Al is an element functioning as a deoxidizer and an element effective for raising the strength of steel. Further, Al is an element effective for promoting the diffusion of Mn at the time of solidification to reduce the microsegregation of Mn. To obtain these effects, the Al content is 0.005% or more. The Al content may also be 0.010% or more, 0.020% or more, or 0.025% or more. On the other hand, if excessively including Al, sometimes the castability deteriorates and the productivity falls. Therefore, the Al content is 0.700% or less. The Al content may also be 0.600% or less, 0.400% or less, 0.300% or less, 0.150% or less, 0.100% or less, or 0.070% or less.

[N: 0.0150% or Less]

N is an element entering in the production process. The N content may also be 0%. However, reduction of the N content to less than 0.0001% requires time for refining and a drop in productivity is invited. Therefore, the N content may also be 0.0001% or more, 0.0005% or more, or 0.0010% or more. On the other hand, if excessively including N, nitrides are formed and sometimes the steel sheet falls in ductility, hole expandability, stretch flangeability, and/or bendability and other formability. Therefore, the N content is 0.0150% or less. The N content may also be 0.0100% or less, 0.0080% or less, or 0.0050% or less.

[O: 0.0100% or Less]

O is an element entering in the production process. The O content may also be 0%. However, reduction of the O content to less than 0.0001% requires time for refining and a drop in productivity is invited. Therefore, the O content may also be 0.0001% or more, 0.0005% or more, or 0.0010% or more. On the other hand, if excessively including 0, coarse oxides are formed and sometimes the steel sheet falls in ductility, hole expandability, stretch flangeability, and/or bendability and other formability. Therefore, the O content is 0.0100% or less. The O content may also be 0.0070% or less, 0.0040% or less, 0.0030% or less, or 0.0020% or less.

The basic chemical composition of the steel sheet according to this embodiment of the present invention is as explained above. Furthermore, the steel sheet may, according to need, contain one or more of the following optional elements in place of part of the Fe of the balance. Below, these optional elements will be explained in detail. The lower limits of the contents of these optional elements are all 0%.

[Cr: 0 to 0.80%]

Cr is an element raising the hardenability of steel and contributing to improvement of the strength of steel sheet. Further, Cr is an element effective for promoting the diffusion of Mn at the time of solidification to reduce the microsegregation of Mn. The Cr content may also be 0%, but to sufficiently obtain these effects, the Cr content is preferably 0.001% or more. The Cr content may also be 0.01% or more, 0.10% or more, 0.20% or more, or 0.30% or more. On the other hand, if excessively including Cr, sometimes coarse Cr carbides becoming starting points of fracture are formed. Therefore, the Cr content is preferably 0.80% or less. The Cr content may also be 0.70% or less, 0.60% or less, or 0.50% or less.

[Mo: 0 to 0.50%]

Mo is an element suppressing phase transformation at a high temperature and contributing to improvement of the strength of steel sheet. Further, Mo is an element effective for promoting the diffusion of Mn at the time of solidification to reduce the microsegregation of Mn. The Mo content may also be 0%, but to sufficiently obtain these effects, the Mo content is preferably 0.001% or more. The Mo content may also be 0.01% or more, 0.05% or more, or 0.07% or more. On the other hand, if excessively including Mo, sometimes the hot workability falls and the productivity falls. Therefore, the Mo content is preferably 0.50% or less. The Mo content may also be 0.40% or less, 0.30% or less, or 0.20% or less.

[B: 0 to 0.0100%]

B is an element suppressing phase transformation at a high temperature and contributing to improvement of the strength of steel sheet. The B content may also be 0%, but to sufficiently obtain these effects, the B content is preferably 0.0001% or more. The B content may also be 0.0005% or more, 0.0010% or more, or 0.0015% or more. On the other hand, if excessively including B, sometimes B precipitates are formed and the strength of the steel sheet falls. Therefore, the B content is preferably 0.0100% or less. The B content may also be 0.0080% or less, 0.0060% or less, or 0.0030% or less.

[Ti: 0 to 0.100%]

Ti is an element having the effect of reducing the amounts of S, N, and O causing the formation of coarse inclusions acting as starting points of fracture. Further, Ti has the effect of making the microstructure finer and improving the strength-formability balance of steel sheet. The Ti content may also be 0%, but to obtain these effects, the Ti content is preferably 0.0010% or more. The Ti content may also be 0.005% or more, 0.007% or more, or 0.010% or more. On the other hand, if excessively including Ti, sometimes coarse Ti sulfides, Ti nitrides, and/or Ti oxides are formed and the steel sheet falls in formability. Therefore, the Ti content is preferably 0.100% or less. The Ti content may also be 0.080% or less, 0.060% or less, 0.050% or less, or 0.030% or less.

[Nb: 0 to 0.060%]

Nb is an element contributing to improvement of strength of steel sheet due to strengthening by precipitates, grain refinement strengthening by suppression of growth of ferrite crystal grains, and/or dislocation strengthening by suppression of recrystallization. The Nb content may also be 0%, but to obtain these effects, the Nb content is preferably 0.001% or more. The Nb content may also be 0.005% or more, 0.007% or more, or 0.010% or more. On the other hand, if excessively including Nb, sometimes the nonrecrystallized ferrite increases and the steel sheet falls in formability. Therefore, the Nb content is preferably 0.060% or less. The Nb content may also be 0.050% or less, 0.040% or less, or 0.030% or less.

[V: 0 to 0.50%]

V is an element contributing to improvement of strength of steel sheet due to strengthening by precipitates, grain refinement strengthening by suppression of growth of ferrite crystal grains, and/or dislocation strengthening by suppression of recrystallization. The V content may also be 0%, but to obtain these effects, the V content is preferably 0.001% or more. The V content may also be 0.005% or more, 0.01% or more, or 0.02% or more. On the other hand, if excessively including V, sometimes carbonitrides precipitate in large amounts and the steel sheet falls in formability. Therefore, the V content is preferably 0.50% or less. The V content may also be 0.40% or less, 0.20% or less, or 0.10% or less.

[Ni: 0 to 1.00%]

Ni is an element suppressing phase transformation at a high temperature and contributing to improvement of the strength of steel sheet. The Ni content may also be 0%, but to sufficiently obtain these effects, the Ni content is preferably 0.001% or more. The Ni content may also be 0.01% or more, 0.03% or more, or 0.05% or more. On the other hand, if excessively including Ni, sometimes the steel sheet falls in weldability. Therefore, the Ni content is preferably 1.00% or less. The Ni content may also be 0.60% or less, 0.40% or less, or 0.20% or less.

[Cu: 0 to 1.00%]

Cu is an element present in steel in the form of fine grains and contributing to improvement of strength of steel sheet. The Cu content may also be 0%, but to sufficiently obtain these effects, the Cu content is preferably 0.001% or more. The Cu content may also be 0.01% or more, 0.03% or more, or 0.05% or more. On the other hand, if excessively including Cu, sometimes the steel sheet falls in weldability. Therefore, the Cu content is preferably 1.00% or less. The Cu content may also be 0.60% or less, 0.40% or less, or 0.20% or less.

[W: 0 to 1.00%]

W is an element suppressing phase transformation at a high temperature and contributing to improvement of the strength of steel sheet. The W content may also be 0%, but to sufficiently obtain these effects, the W content is preferably 0.001% or more. The W content may also be 0.01% or more, 0.02% or more, or 0.10% or more. On the other hand, if excessively including W, sometimes the hot workability falls and the productivity falls. Therefore, the W content is preferably 1.00% or less. The W content may also be 0.80% or less, 0.50% or less, 0.20% or less, or 0.15% or less.

[Sn: 0 to 1.00%]

Sn is an element suppressing coarsening of crystal grains and contributing to improvement of the strength of steel sheet. The Sn content may also be 0%, but to sufficiently obtain these effects, the Sn content is preferably 0.001% or more. The Sn content may also be 0.01% or more, 0.05% or more, or 0.08% or more. On the other hand, if excessively including Sn, sometimes embrittlement of the steel sheet is triggered. Therefore, the Sn content is preferably 1.00% or less. The Sn content may also be 0.80% or less, 0.50% or less, 0.20% or less, or 0.15% or less.

[Sb: 0 to 0.200%]

Sb is an element suppressing coarsening of crystal grains and contributing to improvement of the strength of steel sheet. The Sb content may also be 0%, but to sufficiently obtain these effects, the Sb content is preferably 0.001% or more. The Sb content may also be 0.003% or more, 0.005% or more, or 0.010% or more. On the other hand, if excessively including Sb, sometimes embrittlement of the steel sheet is triggered. Therefore, the Sb content is preferably 0.200% or less. The Sb content may also be 0.150% or less, 0.100% or less, 0.050% or less, or 0.020% or less.

[Ca: 0 to 0.0100%]

[Mg: 0 to 0.0100%]

[Zr: 0 to 0.0100%]

[REM: 0 to 0.0100%]

Ca, Mg, Zr, and REM are elements contributing to improvement of the formability of steel sheet. The Ca, Mg, Zr, and REM contents may also be 0%, but to sufficiently obtain these effects, the Ca, Mg, Zr, and REM contents are preferably respectively 0.0001% or more and may be 0.0005% or more, 0.0010% or more, or 0.0015% or more. On the other hand, if excessively including these elements, sometimes the steel sheet falls in ductility. Therefore, the Ca, Mg, Zr and REM contents are preferably respectively 0.0100% or less and may be 0.0080% or less, 0.0060% or less, 0.0030% or less, or 0.0020% or less. The "REM" in this Description is the general name for the 17 elements of the atomic number 21 scandium (Sc), atomic number 39 yttrium (Y), and the lanthanoids atomic number 57 lanthanum (La) to atomic number 71 lutetium (Lu). The REM content is the total content of these elements.

In the steel sheet according to an embodiment of the present invention, the balance other than these elements consists of Fe and impurities. The "impurities" are constituents, etc., entering due to various factors in the production process starting from materials such as ore and scrap, etc., when industrially producing a steel sheet. The impurities, include for example, H, Na, Cl, Co, Zn, Ga, Ge, As, Se, Y, Tc, Ru, Rh, Pd, Ag, Cd, In, Te, Cs, Ta, Re, Os, Ir, Pt, Au, Pb, Bi, and Po. The impurities may be included in a total of 0.100% or less.

[Index A: 1.10% or Less]

The chemical composition of the steel sheet according to an embodiment of the present invention has to have an index A represented by following formula 1 of 1.10% or less:

$$A=10[C]+0.3[Mn]-0.2[Si]-0.6[Al]-0.05[Cr]-0.2[Mo] \quad \text{formula 1}$$

where [C], [Mn], [Si], [Al], [Cr], and [Mo] are the contents of the elements [mass %], and when the elements are not contained, the contents are 0%. As explained previously, in the steel sheet according to an embodiment of the present invention, in order to improve the appearance after forming, reducing the microsegregation of Mn is extremely important. To reduce the microsegregation of Mn, promoting the diffusion of Mn at the time of casting a slab from molten steel is effective. By controlling the chemical composition of the steel sheet so that the above index A becomes 1.10% or less, it is possible to make the mode of solidification when casting the slab the 6 solidification and promote the diffusion of Mn. As a result, it is possible to remarkably suppress the microsegregation of Mn and in relation to this possible to reduce the hard phase connected in streaks in the microstructure of the finally obtained steel sheet, more specifically control the maximum connected length of the hard phase in a rolling direction at the sheet thickness ¼ position to 40 μm or less. The index A is 1.08% or less, 1.05% or less, 1.03% or less, 1.00% or less, 0.98% or less, or 0.95% or less. The lower limit of the index A is not particularly limited, but for example the index A may be 0.65% or more, 0.70% or more, 0.75% or more, 0.80% or more, 0.85% or more, 0.88% or more, or 0.90% or more.

The chemical composition of the steel sheet may be measured by a general analysis method. For example, the chemical composition of the steel sheet may be measured using inductively coupled plasma-atomic emission spectrometry (ICP-AES). C and S may be measured using the combustion-infrared absorption method, N may be measured using the inert gas melting-thermal conductivity method, and O may be measured by the inert gas melting-nondispersion type infrared absorption method.

[Ferrite: 70 to 95% and Hard Phase: 5 to 30%]

The microstructure of the steel sheet is comprised of, by area %, ferrite: 70 to 95% and hard phase: 5 to 30%, more specifically only ferrite: 70 to 95% and hard phase: 5 to 30%. By making the microstructure of the steel sheet such a composite structure, it is possible to maintain the strength of the steel sheet within a suitable range, more specifically achieve a tensile strength of 500 MPa or more, while improving the appearance after forming. From the viewpoint of further raising the strength of steel sheet, the area percentage of the hard phase may be 7% or more, 10% or more, or 12% or more. Similarly, the area percentage of the ferrite may be 93% or less, 90% or less, or 88% or less. On the other hand, from the viewpoint of better improving the appearance after forming, the area percentage of the hard phase may be 28% or less, 26% or less, 23% or less, 20% or less, 18% or less, 16% or less, or 14% or less. Similarly, the area percentage of the ferrite may be 72% or more, 74% or more, 77% or more, 80% or more, 82% or more, 84% or more, or 86% or more.

In the steel sheet according to an embodiment of the present invention, the "hard phase" means structures harder than ferrite. For example, it includes at least one of martensite, bainite, tempered martensite, and pearlite or is comprised of at least one of the same. In particular, it is at least one of martensite, bainite, tempered martensite, and pearlite. From the viewpoint of improving the strength of the steel sheet, the hard phase preferably is comprised of at least one of martensite, bainite, and tempered martensite or is at least one of the same, more preferably is comprised of martensite or is martensite. In an embodiment of the present invention, the microstructure of the steel sheet preferably has little retained austenite. Specifically, the retained austenite is preferably present in an area % of less than 1% or less than 0.5%, more preferably 0%.

[Identification of Microstructure and Calculation of Area Percentage]

The microstructure is identified and the area percentage is calculated as follows: First, from the W/4 position or 3 W/4 position of the width W of the obtained steel sheet (i.e., the W/4 position in the width direction from either end part of the steel sheet in the width direction), a sample for examination of the microstructure (size of generally 20 mm in rolling direction×20 mm in width direction×thickness of steel sheet) is taken. Next, an optical microscope is used to examine the microstructure at sheet thickness ½ thickness from the surface and the area percentage of the hard phase from the surface of the steel sheet (in case of plating being present, the surface after removing the plating layer) to the sheet thickness ½ thickness is calculated. For preparation of the sample, the cross-section of sheet thickness in a direction perpendicular to rolling is polished as the examined surface and is etched by LePera's reagent. Next, the "microstructure" is classified from the 500 or 1000× power optical micrograph. If examining the surface by an optical microscope after LePera corrosion, for example, the different structures are observed colored—with bainite and pearlite black, martensite (including tempered martensite) white, and ferrite gray, therefore ferrite and other hard structures can be easily differentiated. In the optical micrograph, the regions other than the gray color showing ferrite are the hard phase.

In the region of the steel sheet etched by LePera's reagent from the surface to the sheet thickness ½ position in the sheet thickness direction, 10 fields are examined at a power of 500× or 1000×. The "Photoshop CS5" image analysis software made by Adobe is used for image analysis to find the area percentage of the hard phase. As the image analysis method, for example, the maximum luminance value $L_{max}$ and the minimum luminance value $L_{min}$ of the steel sheet are acquired from the image. Parts having pixels of a luminance of $L_{max}-0.3(L_{max}-L_{min})$ to $L_{max}$ are defined as white regions, parts having pixels of $L_{min}$ to $L_{min}+0.3(L_{max}-L_{min})$ are defined as black regions, and other parts are defined as gray regions and the area percentage of the hard phase of the regions other than the gray regions is calculated. The examined fields of the total 10 locations are analyzed in the same way as the above and the area percentages of the hard phase measured. The area percentages are averaged to calculate an average value. This average value is deemed the area percentage of the hard phase and the balance is deemed the area percentage of the ferrite. Note that, the examined area is 150 μm in the sheet thickness direction and 250 μm in the rolling direction (the examined area in this case is 150×250=37500 $\mu m^2$).

Note that when the area percentage of the retained austenite has to be measured, X-ray diffraction of the examined surface can be used to measure the area percentage of the retained austenite. Specifically, Co-Kα rays are used to find the integrated intensity of the total six peaks of the α(110), α(200), α(211), γ(111), γ(200), and γ(220) at the sheet thickness direction ¼ position and the intensity averaging method is used to calculate the volume percentage of the retained austenite. The volume percentage of the retained austenite obtained is the area percentage of the retained austenite.

[Maximum Connected Length of Hard Phase in Rolling Direction at Sheet Thickness ½ Position: 80 μm or Less]

In an embodiment of the present invention, the maximum connected length of the hard phase in a rolling direction at the sheet thickness ½ position of the steel sheet is 80 μm or less. By limiting the hard phase connected in streaks at the sheet thickness ½ position of the steel sheet to within such a range, it is possible to suppress the formation of a banded hard phase at the sheet thickness center part of the steel sheet due to the center segregation of Mn and possible to remarkably diminish ghost lines and other defects in appearance after forming in particular at the sheet thickness center part. From the viewpoint of diminishing defects in the appearance after forming, the shorter the maximum connected length of the hard phase in a rolling direction at the sheet thickness ½ position of the steel sheet the better. For example, it may be for example 75 μm or less, 70 μm or less, 65 μm or less, or 60 μm or less. The lower limit is not particularly prescribed, but for example the maximum connected length of the hard phase in a rolling direction at the sheet thickness ½ position of the steel sheet may be 10 μm or more, or 20 μm or more.

[Maximum Connected Length of Hard Phase in Rolling Direction at Sheet Thickness ¼ Position: 40 μm or Less]

In an embodiment of the present invention, the maximum connected length of the hard phase in a rolling direction at the sheet thickness ¼ position of the steel sheet is 40 μm or less. By limiting the hard phase connected in streaks at the sheet thickness ¼ position of the steel sheet to within such a range, it is possible to suppress the formation of a banded hard phase in the microstructure of the steel sheet due to the microsegregation of Mn and possible to remarkably diminish ghost lines and other defects in appearance after forming due to the microsegregation of Mn in all regions in the thickness direction, including the sheet thickness center part of the steel sheet. From the viewpoint of diminishing the defects in the appearance after forming, the shorter the maximum connected length of the hard phase in a rolling direction at the sheet thickness ¼ position of the steel sheet the better. For example, it may be for example 36 μm or less, 32 μm or less, 28 μm or less, or 26 μm or less. The lower limit is not particularly limited, but for example the maximum connected length of the hard phase in a rolling direction at the sheet thickness ¼ position of the steel sheet may be 5 μm or more or 8 μm or more. The microsegregation of Mn is related to the entire region in the sheet thickness direction of the steel sheet, but in an embodiment of the present invention, typically, the microsegregation of Mn is evaluated and suppressed by examining and controlling the maximum connected length of the hard phase in a rolling direction at the sheet thickness ¼ position of the steel sheet.

[Measurement of Maximum Connected Lengths of Hard Phase in Rolling Direction at Sheet Thickness ½ and ¼ Positions]

The maximum connected length of the hard phase in a rolling direction at the sheet thickness ½ position is measured as follows: First, a cross-section parallel to the sheet thickness direction and rolling direction of the steel sheet and at the center in the width direction of the steel sheet is polished as the examined surface and etched by LePera's reagent. After this, an examined range of a region of 100 μm in the sheet thickness direction from the surface of the steel sheet centered at the ½ thickness position and approximately 800 μm in the rolling direction (connected hard phase examined range) is examined by an optical microscope (the examined area in this case becomes 100 mxapproximately 800 μm=approximately 80000 $\mu m^2$). The length of the connected hard phase examined range in the rolling direction may be less than 800 μm and may be more than 800 m. However, the lower limit of the length of the connected hard phase examined range in the rolling direction is 600 μm and the upper limit is 1000 μm (the examined area in the case of this lower limit becomes 100 μm×600 μm=60000 $\mu m^2$). Next, in the connected hard phase examined range, the hard phase having the connected length in the rolling direction is extracted by image processing. Here, "connected" means the crystal grains of the hard phase are in contact with each other. Next, in the extracted hard phase, the longest connected length in the rolling direction is determined as the "maximum connected length of the hard phase in a rolling direction at the sheet thickness ½ position". The maximum connected length of the hard phase in a rolling direction at the sheet thickness ¼ position is measured and further is determined in the same way as the case of measurement of the maximum connected length of the hard phase in a rolling direction at the sheet thickness ½ position except for changing the "region of 100 μm in the sheet thickness direction from the surface of the steel sheet centered at the ½ thickness position" to the "region of 100 μm in the sheet thickness direction from the surface of the steel sheet centered at the ¼ thickness position".

[Average Crystal Grain Size of Ferrite: 5.0 to 30.0 μm]

According to a preferred embodiment of the present invention, the average crystal grain size of the ferrite in the microstructure is 5.0 to 30.0 μm. By controlling the average crystal grain size of the ferrite to within such a fine range in addition to reduction of center segregation and microsegregation of Mn, it is possible to further improve the appearance of the steel sheet, in particular the appearance after forming. The average crystal grain size of the ferrite may be 7.0 μm or more, 8.0 μm or more, 9.0 μm or more, or 10.0 μm or more. Similarly, the average crystal grain size of the ferrite may be 27.0 μm or less, 25.0 μm or less, 20.0 μm or less, 16.0 μm or less, 14.0 μm or less, or 12.0 μm or less.

The average crystal grain size of the ferrite in the steel sheet is determined in the following way. First, a region of the steel sheet etched by LePera's reagent from the surface to a sheet thickness ½ position in the sheet thickness direction is examined at 10 fields by a power of 500× or 1000×. "Photoshop CS5" image analysis software made by Adobe is used to analyze the images. The area percentages of the ferrite and the number of grains of the ferrite in the fields are respectively calculated. Next, the area percentages of the ferrite and the number of grains of the ferrite in the 10 fields are respectively totaled and the total area percentage of the ferrite is divided by the total number of grains of the ferrite to thereby calculate the average area percentage per ferrite grain. From this average area percentage and number of grains, the circle equivalent diameter is calculated. The obtained circle equivalent diameter is determined as the average crystal grain size of the ferrite. Note that, the examined area is 150 μm in the sheet thickness direction and 250 μm in the rolling direction (the examined area in this case is 150×250=37500 $\mu m^2$).

[Average Crystal Grain Size of Hard Phase: 1.0 to 5.0 μm]

According to a preferred embodiment of the present invention, the average crystal grain size of the hard phase in the microstructure is 1.0 to 5.0 μm. By controlling the average crystal grain size of the hard phase to within such a fine range in addition to reduction of center segregation and microsegregation of Mn, it is possible to further improve the appearance of the steel sheet, in particular the appearance after forming. The average crystal grain size of the hard phase may be 1.2 μm or more, 1.5 μm or more, 1.7 μm or more, or 2.0 μm or more. Similarly, the average crystal grain size of the hard phase may be 4.7 μm or less, 4.5 μm or less, 4.2 μm or less, 4.0 μm or less, 3.8 μm or less, 3.6 μm or less, or 3.4 μm or less.

The average crystal grain size of the hard phase in the steel sheet is determined in the following way. First, a region of the steel sheet etched by LePera's reagent from the surface to a sheet thickness ½ position in the sheet thickness direction is examined at 10 fields by a power of 500× or 1000×. "Photoshop CS5" image analysis software made by Adobe is used to analyze the images. The area percentages of the hard phase and the number of grains of the hard phase in the fields are respectively calculated. Next, the area percentages of the hard phase and the numbers of grains of the hard phase in the 10 fields are totaled and the total area percentage of the hard phase is divided by the total number of grains of the hard phase to calculate the average area percentage per hard phase grain. From this average area percentage and number of grains, the circle equivalent diameter is calculated. The obtained circle equivalent diameter is determined as the average crystal grain size of the hard phase. Note that, the examined area is 150 μm in the sheet thickness direction and 250 μm in the rolling direction (the examined area in this case is 150×250-37500 $\mu m^2$).

[Sheet Thickness]

The steel sheet according to an embodiment of the present invention is not particularly limited, but for example has a 0.1 to 2.0 mm sheet thickness. The steel sheet having such a sheet thickness is optimal in the case of use as a material for a door, hood, or other external sheet member. The sheet thickness may also be 0.2 mm or more, 0.3 mm or more, 0.4 mm or more. Similarly, the sheet thickness may also be 1.8 mm or less, 1.5 mm or less, 1.2 mm or less, or 1.0 mm or less. For example, by making the sheet thickness 0.2 mm or more and 0, it is possible to obtain the additional effects of increased ease of maintaining flat the shape of a shaped part and improved dimensional precision and shape precision. On the other hand, by making the sheet thickness 1.0 mm or less, the effect of lightening the weight of the member becomes remarkable. The sheet thickness of the steel sheet is measured by a micrometer.

[Plating]

The steel sheet according to an embodiment of the present invention is a cold rolled steel sheet, but may also include a plating layer at its surface for the purpose of improving the corrosion resistance etc. The plating layer may be either a hot dip coated layer or an electroplated layer. That is, the steel sheet according to an embodiment of the present invention may be a cold rolled steel sheet having a hot dip coated layer or an electroplated layer at its surface. The hot dip coated layer includes, for example, a hot dip galvanized layer (GI), hot dip galvannealed layer (GA), hot dip aluminum coated layer, hot dip Zn—Al alloy coated layer, hot dip Zn—Al—Mg alloy coated layer, hot dip Zn—Al—Mg—Si alloy coated layer, etc. The electroplated layer includes, for example, an electrogalvanized layer (EG), electro Zn—Ni alloy plated layer, etc. Preferably, the plating layer is a hot dip galvanized layer, hot dip galvannealed layer, or electrogalvanized layer. The amount of deposition of the plating layer is not particularly limited and may be a general amount of deposition.

[Mechanical Properties]

According to the steel sheet having the above chemical composition and microstructure, it is possible to achieve a high tensile strength, specifically a tensile strength of 500 MPa or more. The tensile strength is preferably 540 MPa or more, more preferably 570 MPa or more or 600 MPa or more. The upper limit is not particularly prescribed, but for example the tensile strength may be 980 MPa or less, 850 MPa or less, 750 MPa or less, 700 MPa or less, or 650 MPa or less. By making the tensile strength 850 MPa or less, there is the advantage that it is easy to secure formability when press-forming the steel sheet. The tensile strength is measured by taking from the steel sheet a JIS Z2241: 2011 No. 5 tensile test piece having a direction perpendicular to the rolling direction as the test direction and running a tensile test based on JIS Z2241: 2011.

The steel sheet according to an embodiment of the present invention has a high strength, specifically a tensile strength of 500 MPa or more. Despite this, it is possible to maintain an excellent appearance even after press-forming or other forming. For this reason, the steel sheet according to an embodiment of the present invention is for example extremely useful for application as a roof, hood, fender, door, or other outer panel in automobiles where high design freedom is demanded.

<Method of Production of Steel Sheet>

Next, a preferred method of production of the steel sheet according to an embodiment of the present invention will be explained. The following explanation is intended to illustrate the characterizing method for producing the steel sheet according to an embodiment of the present invention and is not intended to limit the steel sheet to one produced by the method of production such as explained below:

The method of production of the steel sheet according to an embodiment of the present invention is characterized by including a casting step of casting a slab having the chemical composition explained above in relation to the steel sheet and including performing small reduction rolling using a continuous casting machine provided with a plurality of reduction rolls adjoining each other in the slab conveyance direction and having a roll pitch of the adjoining reduction rolls of 290 mm or less.

[Casting Step]

In the steel sheet according to an embodiment of the present invention, as stated earlier, reducing the center segregation and microsegregation of Mn is extremely important. For the microsegregation of Mn, by controlling the chemical composition of the steel sheet so that the index A represented by following formula 1 becomes 1.10% or less, it is possible to make the solidification mode when casting the slab the 6 solidification and promote the diffusion of Mn. Therefore, by suitably controlling the chemical composition of the slab, it is possible to reliably reduce the microsegregation of Mn.

$$A = 10[C] + 0.3[Mn] - 0.2[Si] - 0.6[Al] - 0.05[Cr] - 0.2[Mo] \quad \text{formula 1}$$

where [C], [Mn], [Si], [Al], [Cr], and [Mo] are the contents of the elements [mass %], and when the elements are not contained, the contents are 0%.

On the other hand, for reducing the center segregation of Mn, it may be considered effective to suppress the flow of the molten steel at the time of casting the slab. As explained earlier, at the time of solidification, the molten steel solidifies from the surface and the center part solidifies last. When the molten steel solidifies, the solid phase is discharged from the liquid phase, therefore at that stage, Mn concentrates in the liquid phase. Therefore, if molten steel flows at the time of solidification, such concentrated parts of Mn easily gather at the center part which solidifies last. As a result, the center segregation of Mn becomes remarkable. It is not possible to change itself the solidification process in which the center part solidifies last, therefore suppressing concentration of Mn at the center part to reduce the center segregation is generally extremely difficult.

As opposed to this, the present method of production performs small reduction rolling in the casting step where it uses a continuous casting machine comprised of a plurality of reduction rolls having a relatively short roll pitch of 290 mm or less, preferably 280 mm or less. By this, it is possible to remarkably suppress the flow of molten steel at the time of solidification and thereby reduce the concentration of Mn at such certain parts. Therefore, by performing the casting step including a combination of a 290 mm or less roll pitch and small reduction rolling, it is possible to reliably control the maximum connected length of the hard phase in a rolling direction at the sheet thickness ½ position of the finally obtained steel sheet to 80 μm or less. However, if not satisfying even one of the two requirements of the 290 mm or less roll pitch and small reduction rolling, it is not possible to achieve such a maximum connected length of the hard phase at the sheet thickness ½ position. For this reason, in this casting step, satisfying both requirements of the 290 mm or less roll pitch and small reduction rolling is extremely important. In this method of production, "small reduction rolling" means rolling having a 0.6 mm or more reduction gradient per meter in the casting progression direction.

[Other Steps]

The present method of production may include, in addition to the above casting step, a hot rolling step, cold rolling step, annealing step, and cooling step. Furthermore, the present method of production may also optionally include a plating step. These steps are not particularly limited. It is sufficient to suitably select any suitable conditions so that a microstructure including ferrite and a hard phase explained in relation to the steel sheet in predetermined area percentages is obtained. Below, the preferred conditions of the individual steps will be simply explained.

[Hot Rolling Step]

Before the hot rolling, the slab is heated to 1100° C. or more. By making the heating temperature 1100° C. or more, it is possible to keep the rolling reaction force from becoming excessively large at the hot rolling and make it easier to obtain the targeted product thickness. The upper limit of the heating temperature is not particularly limited, but from the viewpoint of economy, the heating temperature is preferably less than 1300° C. The slab heated in the hot rolling step is next subjected to rough rolling and finish rolling. The obtained hot rolled steel sheet is for example coiled at a 450 to 650° C. coiling temperature. The finish rolling end temperature is preferably 950° C. or less. By making the finish rolling end temperature 950° C. or less, it is possible to make the average crystal grain size of the hot rolled steel sheet and the final product smaller and possible to secure a sufficient yield strength and secure a high surface quality after forming. Further, by making the coiling temperature 450 to 650° C., it is possible to make the average crystal grain size smaller and suppress growth of scale.

[Cold Rolling Step]

The obtained hot rolled steel sheet is suitably pickled to remove the scale, then is sent on to the cold rolling step. In the cold rolling step, for example, it is preferable to cold roll the hot rolled steel sheet so that the cumulative rolling reduction becomes 50 to 90%. By controlling the cumulative rolling reduction to such a range, it is possible to secure the desired sheet thickness and, further, sufficiently secure uniformity of the material quality in the sheet width direction while preventing the rolling load from becoming excessive and the rolling from becoming difficult.

[Annealing Step]

In the annealing step, it is preferable to heat and hold the cold rolled steel sheet at a 750 to 900° C. homogenization temperature as annealing treatment. By making the homogenization temperature 750° C. or more, it is possible to sufficiently promote recrystallization of ferrite and reverse transformation from ferrite to austenite and obtain the desired microstructure at the final product. On the other hand, by making the homogenization temperature 900° C. or less, it is possible to make the crystal grains denser and obtain sufficient strength.

[Cooling Step]

After the annealing step, the cold rolled steel sheet is cooled at the next cooling step. At the cooling step, the steel sheet is preferably cooled so that the average cooling speed from the homogenization temperature becomes 5 to 50° C./s. By making the average cooling speed 5° C./s or more, it is possible to suppress excessive transformation to ferrite and increase the amount of formation of martensite and other types of hard phase to obtain the desired strength. Further, by making the average cooling speed 50° C./s or less, it is possible to cool the steel sheet more uniformly in the width direction.

[Plating Step]

The obtained cold rolled steel sheet may be plated on the surface in accordance with need for the purpose of improving the corrosion resistance etc. The plating may be hot dip coating, hot dip alloyed coating, electroplating, or other treatment. For example, as the plating, the steel sheet may be hot dip galvanized or may be hot dip galvanized, then alloyed. The specific conditions of the plating and the alloying are not particularly limited and may be any suitable conditions known to persons skilled in the art. For example, the alloying temperature may also be 450 to 600° C.

Below, examples will be used to explain the present invention in more detail, but the present invention is not limited to these examples in any way.

EXAMPLES

In the following examples, steel sheets according to the embodiments of the present invention were produced under various conditions and the obtained steel sheets were investigated for tensile strength and features of appearance after forming.

Further, a continuous casting machine provided with a plurality of reduction rolls arranged at a predetermined roll pitch was used to cast slabs having the chemical compositions shown in Table 1 and thicknesses of 200 to 300 mm by the continuous casting method. The balance other than the constituents shown in Table 1 is Fe and impurities. In the examples, cases where the casting condition (I): small reduction rolling and the casting condition (II): roll pitch 290 mm or less are satisfied (OK) and cases where they are not satisfied (NG) are respectively shown in Table 2. Specifically, in examples where the casting condition (I) is "OK", rolling is performed with a reduction gradient of 0.7 mm or more per meter in the casting advancing direction. On the other hand, an example where such small reduction rolling was not performed was deemed "NG (no good)". Further, in an example where the casting condition (II) was "OK", the roll pitch was made 270 mm while in an example where the casting condition (II) was "NG", the roll pitch was made 360 mm for the casting.

Next, the obtained slab was subjected to a hot rolling step (heating temperature 1200° C., finish rolling end temperature 900° C., and coiling temperature 550° C.), cold rolling step (cumulative rolling reduction 80%), annealing step (homogenization temperature 800° C.), and cooling step (average cooling speed 10° C./s) to produce a sheet thickness 0.4 mm cold rolled steel sheet. The surface of the obtained cold rolled steel sheet was suitably plated to form a hot dip galvanized layer (GI), hot dip galvannealed layer (GA), or electrogalvanized layer (EG). Further, a sample taken from the produced cold rolled steel sheet was analyzed for chemical composition, whereupon there was no change from the chemical composition of the slab shown in Table 1.

TABLE 1

| Steel | Chemical composition (mass %), balance: Fe and impurities | | | | | | | | | | | | | |
|---|---|---|---|---|---|---|---|---|---|---|---|---|---|---|
| | C | Mn | Si | P | S | Al | N | O | Cr | Mo | B | Ti | Others | Index A |
| A | 0.052 | 1.84 | 0.356 | 0.016 | 0.0018 | 0.031 | 0.0035 | 0.0009 | | | | | | 0.98 |
| B | 0.050 | 1.71 | 0.098 | 0.017 | 0.0021 | 0.026 | 0.0038 | 0.0013 | 0.49 | 0.07 | 0.0018 | 0.010 | | 0.94 |
| C | 0.061 | 1.75 | 0.010 | 0.036 | 0.0026 | 0.310 | 0.0045 | 0.0010 | 0.40 | 0.07 | 0.0020 | 0.012 | | 0.91 |
| D | 0.059 | 1.72 | 0.013 | 0.020 | 0.0017 | 0.302 | 0.0035 | 0.0019 | 0.36 | 0.07 | 0.0015 | | Nb: 0.011, Sb: 0.005 | 0.89 |
| E | 0.076 | 1.86 | 0.282 | 0.018 | 0.0016 | 0.357 | 0.0039 | 0.0015 | 0.46 | 0.11 | 0.0018 | 0.021 | | 1.00 |
| F | 0.060 | 1.65 | 0.115 | 0.025 | 0.0020 | 0.034 | 0.0031 | 0.0009 | 0.28 | 0.07 | | | V: 0.02, REM: 0.0017 | 1.02 |
| G | 0.060 | 1.75 | 0.010 | 0.020 | 0.0021 | 0.035 | 0.0044 | 0.0009 | 0.58 | | 0.0019 | 0.011 | W: 0.02, Cu: 0.05 | 1.07 |
| H | 0.047 | 2.01 | 0.011 | 0.031 | 0.0013 | 0.105 | 0.0048 | 0.0019 | | | | | | 1.01 |
| I | 0.072 | 1.80 | 0.012 | 0.022 | 0.0017 | 0.300 | 0.0035 | 0.0015 | 0.42 | 0.07 | | | Ni: 0.05, Sn: 0.08 | 1.04 |
| J | 0.060 | 1.72 | 0.152 | 0.020 | 0.0028 | 0.054 | 0.0042 | 0.0015 | 0.55 | 0.07 | 0.0020 | 0.011 | Zr: 0.0015, REM: 0.0020 | 1.01 |
| K | 0.060 | 1.70 | 0.152 | 0.015 | 0.0021 | 0.051 | 0.0038 | 0.0015 | 0.53 | 0.07 | 0.0017 | 0.010 | Mg: 0.0034 | 1.01 |
| L | 0.062 | 1.73 | 0.153 | 0.018 | 0.0024 | 0.057 | 0.0035 | 0.0015 | 0.55 | 0.07 | | | Ca: 0.0018 | 1.03 |
| M | 0.075 | 1.88 | 0.401 | 0.020 | 0.0014 | 0.296 | 0.0035 | 0.0012 | 0.25 | 0.06 | | | | 1.03 |
| N | 0.078 | 2.05 | 0.450 | 0.019 | 0.0020 | 0.054 | 0.0036 | 0.0013 | | | | | | 1.27 |
| O | 0.093 | 1.71 | 0.105 | 0.020 | 0.0033 | 0.030 | 0.0033 | 0.0015 | | | | | Nb: 0.020 | 1.40 |
| P | 0.110 | 1.31 | 0.010 | 0.020 | 0.0028 | 0.034 | 0.0035 | 0.0015 | 0.40 | 0.10 | | | | 1.43 |
| Q | 0.061 | 2.61 | 0.102 | 0.016 | 0.0026 | 0.033 | 0.0030 | 0.0014 | | 0.07 | 0.0015 | 0.020 | | 1.34 |
| R | 0.118 | 2.04 | 0.165 | 0.015 | 0.0031 | 0.046 | 0.0041 | 0.0011 | 0.25 | | | 0.026 | | 1.72 |
| S | 0.035 | 1.81 | 0.105 | 0.015 | 0.0029 | 0.030 | 0.0033 | 0.0015 | 0.13 | | | | | 0.85 |
| T | 0.062 | 1.45 | 0.106 | 0.007 | 0.0049 | 0.115 | 0.0019 | 0.0021 | | 0.22 | | | V: 0.16 | 0.92 |
| U | 0.051 | 1.81 | 0.021 | 0.062 | 0.0008 | 0.612 | 0.0012 | 0.0008 | 0.15 | | 0.0011 | 0.008 | | 0.67 |
| V | 0.046 | 1.15 | 0.154 | 0.008 | 0.0015 | 0.016 | 0.0024 | 0.0024 | | 0.41 | | 0.014 | | 0.68 |
| W | 0.059 | 1.36 | 0.064 | 0.015 | 0.0020 | 0.039 | 0.0055 | 0.0016 | 0.18 | 0.14 | | 0.052 | | 0.92 |
| X | 0.050 | 1.68 | 0.827 | 0.009 | 0.0031 | 0.156 | 0.0014 | 0.0014 | | | 0.0018 | 0.023 | | 0.75 |
| Y | 0.082 | 1.20 | 0.343 | 0.014 | 0.0012 | 0.207 | 0.0010 | 0.0011 | 0.22 | 0.06 | 0.0025 | | Nb: 0.041 | 0.96 |
| Z | 0.053 | 1.53 | 0.122 | 0.020 | 0.0016 | 0.052 | 0.0029 | 0.0018 | | | | 0.015 | Cu: 0.32, Ni: 0.14 | 0.93 |

Underlines show outside scope of present invention.

TABLE 2

| Steel sheet | | Casting condition | | Microstructure | | | | | | | Properties | | |
|---|---|---|---|---|---|---|---|---|---|---|---|---|---|
| | | | | Ferrite | Hard phase | Ferrite average | Hard phase average | Maximum connected length of | Maximum connected length of | | | | |
| | | | | area | area | crystal | crystal | hard phase | hard phase | Plating | Tensile strength | Appearance after | |
| no. | Steel | (I) | (II) | (%) | (%) | (μm) | (μm) | (μm) | (μm) | type | (MPa) | forming | Remarks |
| 1 | A | OK | OK | 93 | 7 | 18.4 | 4.3 | 40 | 10 | GA | 554 | 2 | Inv. ex. |
| 2 | B | OK | OK | 90 | 10 | 10.4 | 3.1 | 53 | 26 | GA | 596 | 3 | Inv. ex. |
| 3 | C | OK | OK | 88 | 12 | 9.2 | 2.5 | 55 | 30 | GA | 608 | 3 | Inv. ex. |
| 4 | C | NG | OK | 89 | 11 | 9.6 | 2.4 | 86 | 25 | GA | 604 | 4 | Comp. ex. |
| 5 | C | NG | NG | 89 | 11 | 9.3 | 2.5 | 105 | 28 | GA | 610 | 5 | Comp. ex. |
| 6 | D | OK | OK | 88 | 12 | 8.8 | 2.4 | 58 | 26 | GI | 621 | 3 | Inv. ex. |
| 7 | E | OK | OK | 85 | 15 | 9.0 | 2.6 | 70 | 24 | GA | 655 | 3 | Inv. ex. |
| 8 | F | OK | OK | 90 | 10 | 10.5 | 3.3 | 72 | 20 | None | 615 | 3 | Inv. ex. |
| 9 | G | OK | OK | 87 | 13 | 8.9 | 2.6 | 59 | 18 | EG | 606 | 3 | Inv. ex. |
| 10 | H | OK | OK | 92 | 8 | 15.3 | 3.9 | 41 | 13 | GA | 578 | 2 | Inv. ex. |
| 11 | H | OK | NG | 91 | 9 | 14.2 | 3.2 | 86 | 18 | GA | 570 | 4 | Comp. ex. |
| 12 | H | NG | NG | 92 | 8 | 14.0 | 3.4 | 100 | 20 | GA | 582 | 5 | Comp. ex. |
| 13 | I | OK | OK | 82 | 18 | 11.3 | 3.4 | 48 | 32 | GA | 662 | 3 | Inv. ex. |
| 14 | J | OK | OK | 88 | 12 | 8.6 | 2.2 | 50 | 25 | GA | 625 | 3 | Inv. ex. |
| 15 | K | OK | OK | 89 | 11 | 8.3 | 2.5 | 58 | 20 | GI | 613 | 3 | Inv. ex. |
| 16 | L | OK | OK | 88 | 12 | 9.9 | 2.9 | 60 | 18 | GA | 609 | 3 | Inv. ex. |
| 17 | L | NG | NG | 89 | 11 | 10.2 | 3.0 | 118 | 20 | GA | 606 | 5 | Comp. ex. |
| 18 | M | OK | OK | 74 | 26 | 8.4 | 2.4 | 72 | 36 | GA | 792 | 3 | Inv. ex. |
| 19 | N | OK | OK | 87 | 13 | 13.5 | 3.6 | 63 | 48 | GA | 643 | 4 | Comp. ex. |
| 20 | O | OK | OK | 80 | 20 | 9.1 | 2.9 | 71 | 54 | GI | 710 | 5 | Comp. ex. |
| 21 | P | OK | OK | 88 | 12 | 12.3 | 3.4 | 68 | 50 | GA | 611 | 5 | Comp. ex. |
| 22 | Q | OK | OK | 83 | 17 | 10.1 | 3.1 | 58 | 44 | GA | 675 | 5 | Comp. ex. |
| 23 | R | OK | OK | 65 | 35 | 8.9 | 2.4 | 78 | 65 | GA | 886 | 5 | Comp. ex. |
| 24 | S | OK | OK | 97 | 3 | 20.1 | 4.8 | 45 | 8 | None | 475 | 2 | Comp. ex. |
| 25 | T | OK | OK | 91 | 9 | 16.8 | 3.9 | 50 | 21 | GA | 574 | 3 | Inv. ex. |
| 26 | U | OK | OK | 90 | 10 | 10.1 | 3.0 | 61 | 11 | GI | 609 | 3 | Inv. ex. |
| 27 | V | OK | OK | 93 | 7 | 9.9 | 3.1 | 44 | 10 | GA | 549 | 2 | Inv. ex. |
| 28 | W | OK | OK | 89 | 11 | 8.0 | 2.0 | 65 | 24 | GA | 618 | 3 | Inv. ex. |
| 29 | X | OK | OK | 88 | 12 | 8.8 | 2.6 | 52 | 16 | GA | 629 | 3 | Inv. ex. |

TABLE 2-continued

| Steel sheet | | Casting condition | | Microstructure | | | | | | | Properties | | |
|---|---|---|---|---|---|---|---|---|---|---|---|---|---|
| | | | | Ferrite | Hard phase | Ferrite average | Hard phase average | Maximum connected length of | Maximum connected length of | | | | |
| | | | | area | area | crystal | crystal | hard phase | hard phase | Plating | Tensile strength | Appearance after | |
| no. | Steel | (I) | (II) | (%) | (%) | (μm) | (μm) | (μm) | (μm) | type | (MPa) | forming | Remarks |
| 30 | Y | OK | OK | 89 | 11 | 7.5 | 1.9 | 58 | 26 | EG | 620 | 3 | Inv. ex. |
| 31 | Z | OK | OK | 90 | 10 | 9.2 | 2.8 | 40 | 20 | GA | 601 | 2 | Inv. ex. |

Underlines indicate outside scope of present invention or not preferable.

The properties of the obtained steel sheet were measured and evaluated by the following methods.

[Tensile Strength]

The tensile strength was measured by taking from the steel sheet a JIS Z2241: 2011 No. 5 tensile test piece having a direction perpendicular to the rolling direction as the test direction and running a tensile test based on JIS Z2241: 2011.

[Appearance After Forming]

The appearance after forming was evaluated by the extent of ghost lines appearing at the surface of an outer door after forming. The surface after press-forming was ground, a striated pattern of several mm order pitch formed at the surface was judged as ghost lines, and the striated pattern was evaluated as 1 to 5 by the extent of formation. Any 100 mm×100 mm region was visually checked. A case where no striated pattern at all was confirmed was evaluated as "1", a case where a maximum length of the striated pattern was 20 mm or less was evaluated as "2", a case where a maximum length of the striated pattern was more than 20 mm and 50 mm or less was evaluated as "3", a case where a maximum length of the striated pattern was more than 50 mm and 70 mm or less was evaluated as "4", and a case where a maximum length of the striated pattern was more than 70 mm was evaluated as "5". If evaluated as "3" or less, it was judged that the door was excellent in appearance after forming and passed. On the other had, if evaluated as "4" or more, the door was evaluated as inferior in appearance after forming and failed.

If the tensile strength was 500 MPa or more and the appearance after forming was evaluated as "3" or less, the steel sheet was evaluated as high strength steel sheet having an improved appearance after forming. The results are shown in Table 2. In the microstructure shown in Table 2, the hard phase included at least one of martensite, bainite, tempered martensite, and pearlite or was at least one of these. Further, as a result of measurement of retained austenite by X-ray diffraction, the area ratio of the retained austenite was less than 1% in all of the examples.

Referring to Table 2, in Comparative Example 4, small reduction rolling was not performed in the casting step, therefore center segregation of Mn was not sufficiently suppressed and the maximum connected length of the hard phase in a rolling direction at the sheet thickness ½ position became more than 80 μm. As a result, the appearance after forming deteriorated. In Comparative Example 11, the roll pitch at the casting step was long, therefore similarly center segregation of Mn could not be sufficiently suppressed and the maximum connected length of the hard phase in a rolling direction at the sheet thickness ½ position became more than 80 μm. As a result, the appearance after forming deteriorated. In each of Comparative Examples 5, 12, and 17, small reduction rolling was not performed in the casting step and the roll pitch was also long, therefore compared with Comparative Examples 4 and 11, the maximum connected length of the hard phase in a rolling direction at the sheet thickness ½ position became further longer and in relation to this the appearance after forming further deteriorated. In each of Comparative Examples 19 and 20, the value of the index A was high, therefore microsegregation of Mn was not sufficiently suppressed and the maximum connected length of the hard phase in a rolling direction at the sheet thickness ¼ position became more than 40 μm. As a result, the appearance after forming deteriorated. In each of Comparative Examples 21 to 23, the C or Mn content as high and the value of the index A was also high, therefore microsegregation of Mn could not be sufficiently suppressed and the maximum connected length of the hard phase in a rolling direction at the sheet thickness ¼ position became more than 40 μm. As a result, the appearance after forming deteriorated. In Comparative Example 24, the C content was low, therefore the area percentage of the hard phase became lower and sufficient strength could not be obtained.

In contrast to this, in each of Invention Examples 1 to 3, 6 to 10, 13 to 16, 18, and 25 to 31, by having a predetermined chemical composition and microstructure, in particular by controlling the maximum connected lengths of the hard phase in a rolling direction at the sheet thickness ½ and ¼ positions respectively to 80 μm or less and 40 μm or less, it is possible to maintain the high strength of the tensile strength 500 MPa or more while remarkably suppressing formation of fine irregularities at the surface of the steel sheet even when strain is imparted due to press-forming to thereby remarkably suppress the formation of ghost lines.

The invention claimed is:

1. A steel sheet having a chemical composition comprising, by mass %,

C: 0.040 to 0.100%,
Mn: 1.00 to 2.50%,
Si: 0.005 to 1.500%,
P: 0.100% or less,
S: 0.0200% or less,
Al: 0.005 to 0.700%,
N: 0.0150% or less,
O: 0.0100% or less,
Cr: 0 to 0.80%,
Mo: 0 to 0.50%,
B: 0 to 0.0100%,
Ti: 0 to 0.100%,
Nb: 0 to 0.060%,
V: 0 to 0.50%,
Ni: 0 to 1.00%, Cu: 0 to 1.00%,
W: 0 to 1.00%,
Sn: 0 to 1.00%,
Sb: 0 to 0.200%,
Ca: 0 to 0.0100%,
Mg: 0 to 0.0100%,
Zr: 0 to 0.0100%,
REM: 0 to 0.0100%, and
balance: Fe and impurities, wherein
an index A represented by following formula 1 is 1.10% or less, and
a microstructure comprising, by area %,
ferrite: 70 to 95%, and
a hard phase: 5 to 30%, wherein
a maximum connected length of the hard phase in a rolling direction at a sheet thickness ½ position is 80 μm or less, and
a maximum connected length of the hard phase in a rolling direction at a sheet thickness ¼ position is 40 μm or less:

$$A=10[C]+0.3[Mn]-0.2[Si]-0.6[Al]-0.05[Cr]-0.2[Mo] \quad \text{formula 1}$$

where [C], [Mn], [Si], [Al], [Cr], and [Mo] are the contents of the elements [mass %], and when the elements are not contained, the contents are 0%.

2. The steel sheet according to claim 1, wherein the chemical composition contains, by mass %, one or more of
Cr: 0.001 to 0.80%,
Mo: 0.001 to 0.50%,
B: 0.0001 to 0.0100%,
Ti: 0.001 to 0.100%,
Nb: 0.001 to 0.060%,
V: 0.001 to 0.50%,
Ni: 0.001 to 1.00%,
Cu: 0.001 to 1.00%,
W: 0.001 to 1.00%,
Sn: 0.001 to 1.00%,
Sb: 0.001 to 0.200%,
Ca: 0.0001 to 0.0100%,
Mg: 0.0001 to 0.0100%,
Zr: 0.0001 to 0.0100%, and
REM: 0.0001 to 0.0100%.

3. The steel sheet according to claim 1, wherein an average crystal grain size of the ferrite is 5.0 to 30.0 μm and an average crystal grain size of the hard phase is 1.0 to 5.0 μm.

4. The steel sheet according to claim 1, wherein the hard phase is comprised of at least one of martensite, bainite, tempered martensite, and pearlite.

* * * * *